US010189072B2

(12) United States Patent
Belk et al.

(10) Patent No.: US 10,189,072 B2
(45) Date of Patent: Jan. 29, 2019

(54) METHOD AND SYSTEM FOR INCREMENTAL SHEET FORMING OF TAILORED BLANKS

(71) Applicant: The Boeing Company, Huntington Beach, CA (US)

(72) Inventors: John Huntley Belk, Saint Louis, MO (US); Om Prakash, Karnataka (IN)

(73) Assignee: THE BOEING COMPANY, Chicago, IL (US)

( * ) Notice: Subject to any disclaimer, the term of this patent is extended or adjusted under 35 U.S.C. 154(b) by 351 days.

(21) Appl. No.: 14/678,092

(22) Filed: Apr. 3, 2015

(65) Prior Publication Data

US 2016/0288189 A1 Oct. 6, 2016

(51) Int. Cl.

| | |
|---|---|
| ***B21D 31/00*** | (2006.01) |
| ***B21D 37/16*** | (2006.01) |
| ***B21D 35/00*** | (2006.01) |

(52) U.S. Cl.

CPC ..... *B21D 31/005* (2013.01); *B21D 35/006* (2013.01); *B21D 37/16* (2013.01)

(58) Field of Classification Search

CPC .. B21D 35/002; B21D 35/005; B21D 35/007; B21D 31/005; B21D 22/18; B21D 39/031; B21D 39/032; B21D 39/037

See application file for complete search history.

(56) References Cited

U.S. PATENT DOCUMENTS

| | | | | |
|---|---|---|---|---|
| 3,050,830 | A * | 8/1962 | Genter | B21D 22/18 29/891 |
| 7,143,514 | B2 * | 12/2006 | Kamada | B21D 39/00 29/897.2 |
| 7,523,850 | B2 * | 4/2009 | Barnes | B21D 26/055 228/112.1 |
| 8,732,953 | B2 * | 5/2014 | Schubetzer | F16B 5/0056 29/897.2 |
| 2002/0041050 | A1 * | 4/2002 | Jung | B29C 53/04 264/156 |
| 2006/0191978 | A1 | 8/2006 | Barnes | |
| 2010/0257909 | A1 | 10/2010 | Huskamp et al. | |
| 2016/0030992 | A1 * | 2/2016 | Clarke | B21D 22/022 148/535 |

FOREIGN PATENT DOCUMENTS

| | | | | |
|---|---|---|---|---|
| DE | 19621944 | A1 * | 5/1997 | B62D 21/09 |
| DE | 102010025963 | A1 | 1/2012 | |
| DE | 102011005977 | A1 | 9/2012 | |
| EP | 1462189 | A1 | 9/2004 | |

OTHER PUBLICATIONS

Extended European Search Report for Application No. 16162811.0, dated Sep. 9, 2016, 6 pages.

CN First Office Action for related application 2016101957391 dated Jul. 20, 2018; 26 pp.

* cited by examiner

*Primary Examiner* — Debra Sullivan

(74) *Attorney, Agent, or Firm* — Armstrong Teasdale LLP

(57) ABSTRACT

A method of making a sheet metal component from a tailored blank includes altering an initial blank formed from a first material to form the tailored blank by at least one of (i) coupling additional material to a portion of the first material, and (ii) removing the first material from a portion of the initial blank. The method also includes forming the sheet metal component from the tailored blank by an incremental sheet forming process.

23 Claims, 6 Drawing Sheets

METHOD AND SYSTEM FOR INCREMENTAL SHEET FORMING OF TAILORED BLANKS

BACKGROUND

The field of the disclosure relates generally to incremental sheet forming, and, more particularly, to systems and methods for incremental sheet forming of tailored blanks.

Many structures, such as but not limited to aircraft, include components formed from sheet metal. At least some such components can be at least partially formed by a process of incremental sheet forming, in which a flat, unitary blank of sheet metal is held in a fixture while at least one stylus is used to deform the blank into a desired three-dimensional shape of the sheet metal component. For example, a single stylus may be used, optionally in cooperation with a forming die, or dual styluses may be used on opposing sides of the blank. The geometric changes desired from such incremental sheet forming processes typically have specific requirements in regard to extent and variation of localized thinning, but the actual deformation process may tend to cause localized, uneven thinning of certain portions of the sheet metal which can be difficult to manage. In at least some cases, incremental sheet forming results in the finished component exhibiting one or more of an undesirable stiffness characteristic, residual stresses that cause a "springback" tendency, and other undesirable effects. In addition, an economic viability of components formed by incremental sheet forming depends in part upon the speed with which the forming process can be completed, but increasing the speed of the process in some cases tends to cause unplanned stress distribution and microstructure changes during the forming process.

BRIEF DESCRIPTION

In one aspect, a method of making a sheet metal component from a tailored blank is provided. The method includes altering an initial blank formed from a first material to form the tailored blank by at least one of (i) coupling additional material to a portion of the first material, and (ii) removing the first material from a portion of the initial blank. The method also includes forming the sheet metal component from the tailored blank by an incremental sheet forming process.

The features, functions, and advantages that have been discussed can be achieved independently in various embodiments or may be combined in yet other embodiments further details of which can be seen with reference to the following description and drawings.

DETAILED DESCRIPTION

Embodiments of the methods and systems described herein provide for altering a sheet metal blank prior to and/or during an incremental sheet forming process to form a tailored blank. Use of the tailored blank for incremental sheet forming changes a local stiffness and/or local thickness of a sheet metal component formed from the tailored blank. In certain embodiments, the altered properties can be selected to improve at least one of the incremental forming process, an additional manufacturing process associated with making the component, or a performance of the component during its intended use. For example, the tailored blank is altered to improve compliance for at least a portion of the sheet metal component with at least one of a specified thickness, a specified stiffness, and a specified geometry. In certain embodiments, an initial blank is formed from a first material, and the initial blank is altered, prior to and/or during the incremental sheet forming process, to improve such compliance by at least one of (i) coupling additional material to a portion of the first material, and (ii) removing the first material from a portion of the blank.

Unless otherwise indicated, "coupled" as used herein encompasses both elements that are associated directly and elements that are associated indirectly. For example, a member A coupled to a member B may be directly associated with a member B, or may be indirectly associated therewith, for example, via another member C. Moreover, unless otherwise indicated, reference to elements that are "coupled" together encompasses both elements that are fastened, adhered, or otherwise secured together, and elements that are coupled, for example by physical contact, in an unsecured fashion. Additionally, unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item. Additionally, unless otherwise indicated, approximating language, such as "generally" and "substantially," as used herein indicates that the term so modified may apply to only an approximate degree, as would be recognized by one of ordinary skill in the art, rather than to an absolute or perfect degree.

Figure 7:
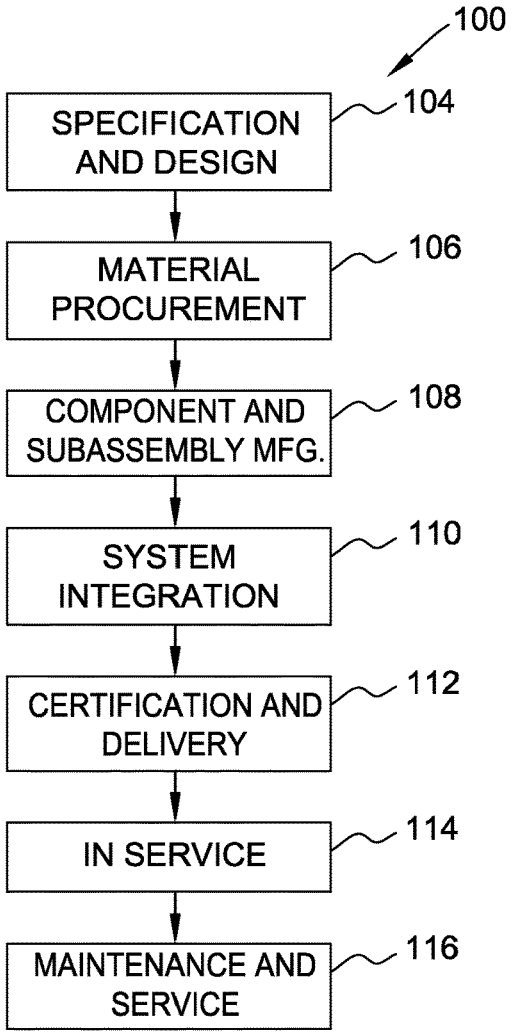
FIG. 7 is a flow diagram of an exemplary aircraft production and service methodology.
Figure 8:
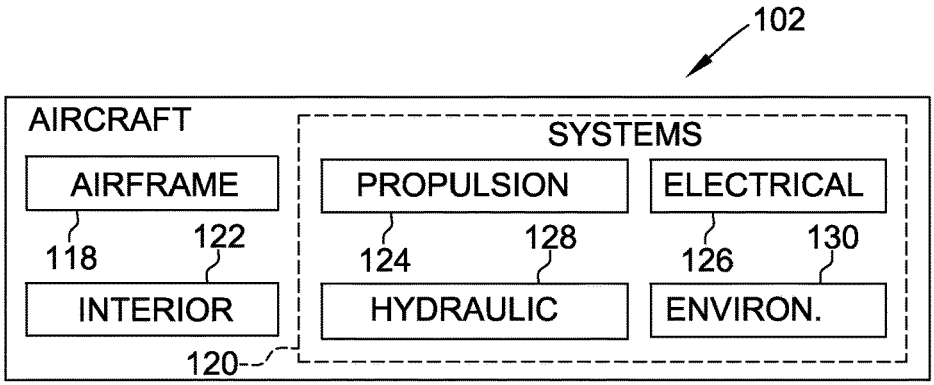
FIG. 8 is a schematic view of an exemplary aircraft.

Referring more particularly to the drawings, embodiments of the disclosure may be described in the context of an exemplary aircraft manufacturing and service method 100 as shown in FIG. 7 and an exemplary aircraft 102 as shown in FIG. 8. It should be understood, however, that although an aerospace example is shown, the principles of the disclosure may be applied to other structures virtually without limitation.

Figure 1:
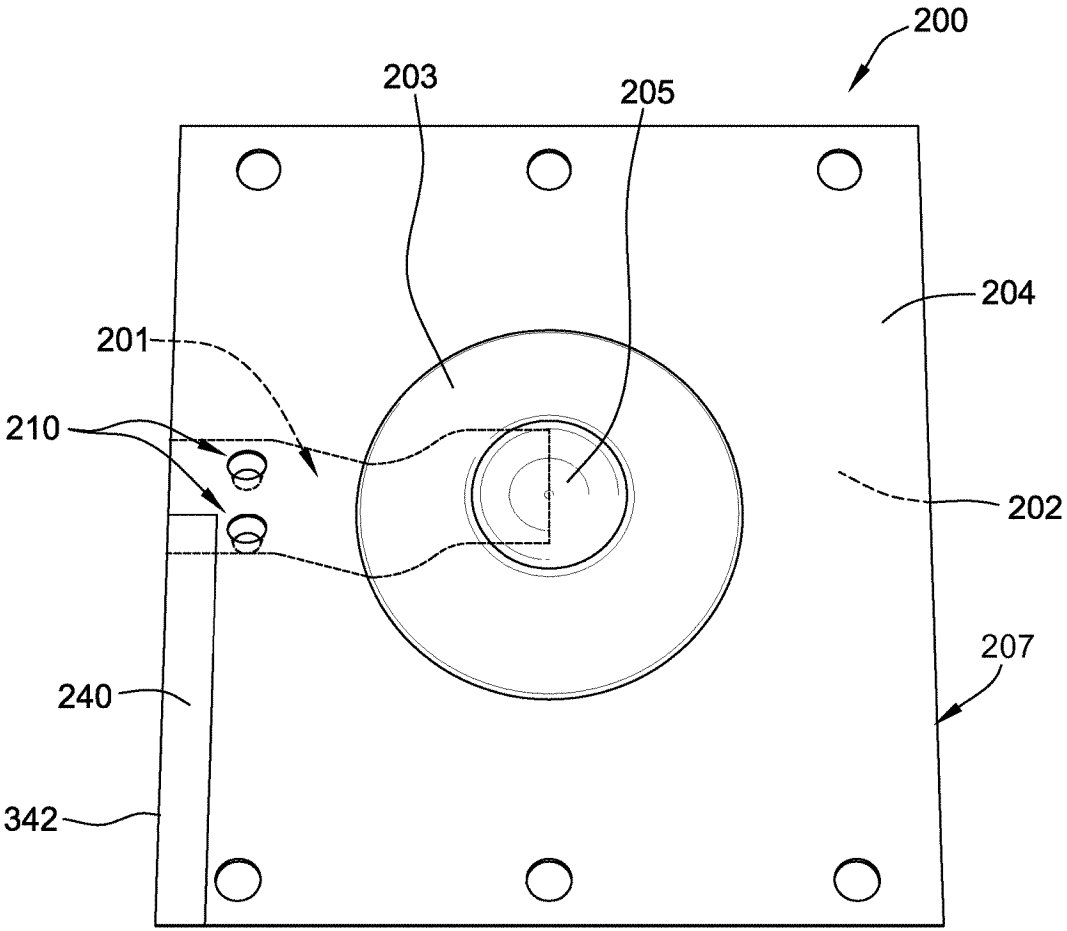
FIG. 1 is a schematic perspective view of an exemplary embodiment of a sheet metal component that may be used with the exemplary aircraft shown in FIG. 8.
Figure 2:
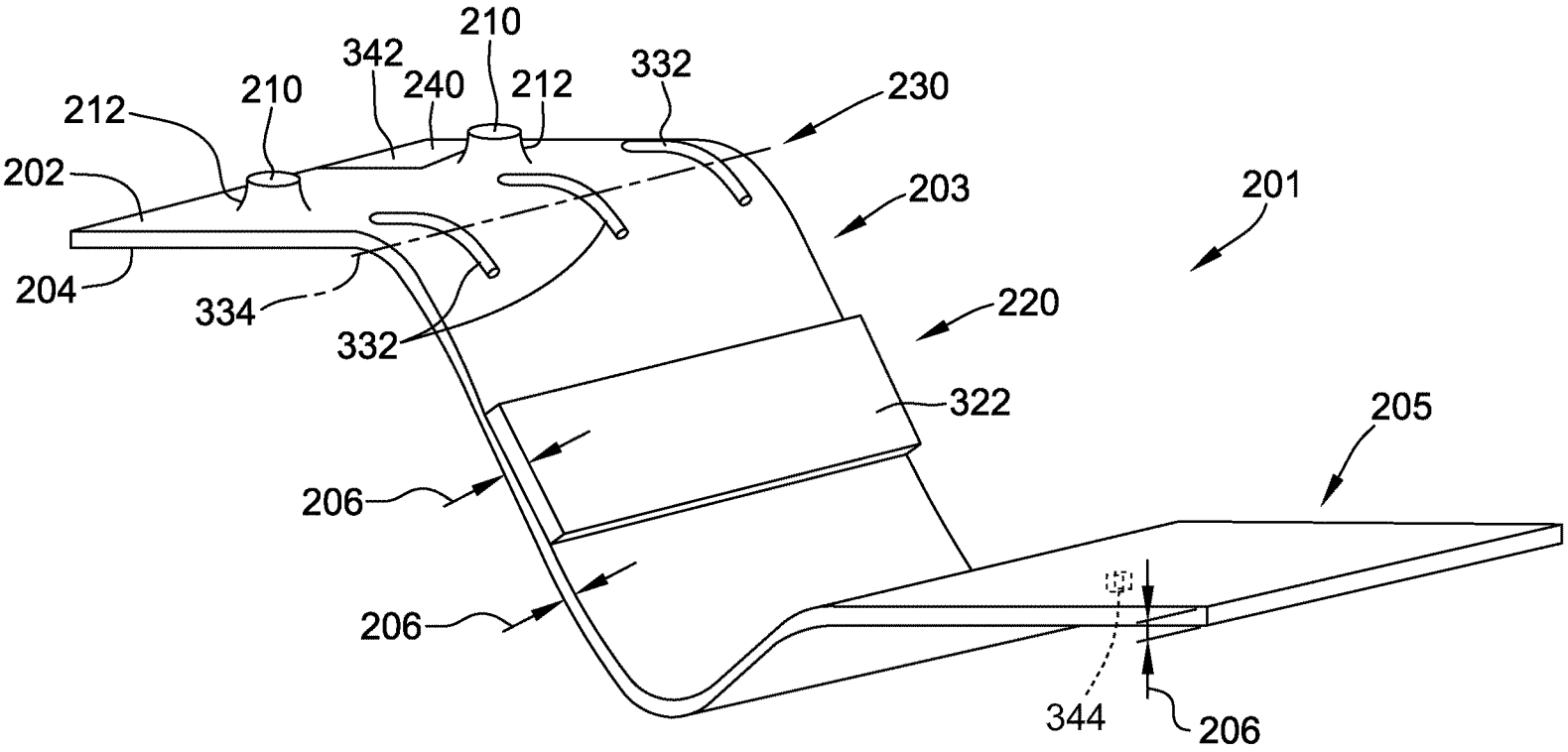
FIG. 2 is a schematic perspective view of a radial section of the exemplary sheet metal component shown in FIG. 1.
Figure 3:
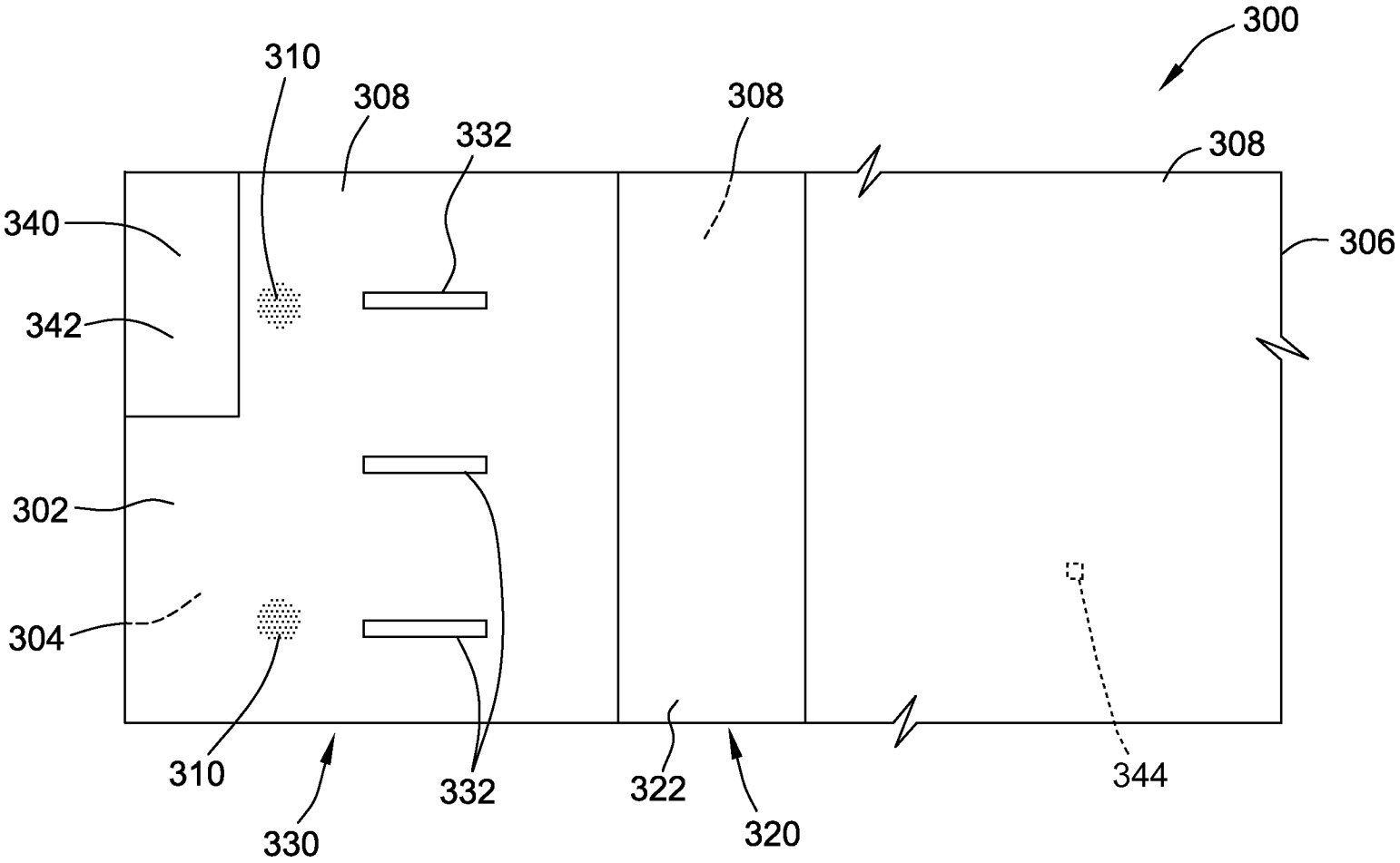
FIG. 3 is a schematic plan view of an exemplary embodiment of a portion of a tailored blank that may be used to form the sheet metal component shown in FIG. 1.

FIG. 1 is a schematic perspective view of an exemplary embodiment of a sheet metal component 200 that forms part of aircraft 102, FIG. 2 is a schematic perspective view of a radial section 201 of exemplary sheet metal component 200, and FIG. 3 is a schematic plan view of a portion of an exemplary embodiment of a tailored blank 300 that may be used to form sheet metal component 200. In the illustrated embodiment, component 202 includes a central dome-shaped feature 203 that extends out of a plane 207 defined by a periphery of component 200. Dome-shaped feature 203 further includes a central inversion region 205 that extends back towards plane 207. Radial section 201 in the view of FIG. 2 is rotated approximately 180 degrees from the view of FIG. 1.

Although sheet metal component 200 is described as being a component of aircraft 102, it should be understood that in alternative embodiments, sheet metal component 200 may be a component of any other suitable structure. Moreover, although sheet metal component 200 and tailored blank 300 each are illustrated as having a specific shape for purposes of description, it should be understood that each of sheet metal component 200 and tailored blank 300 may have any suitable shape such that sheet metal component 200 can be formed from tailored blank 300 according the embodiments described herein.

Figure 4:
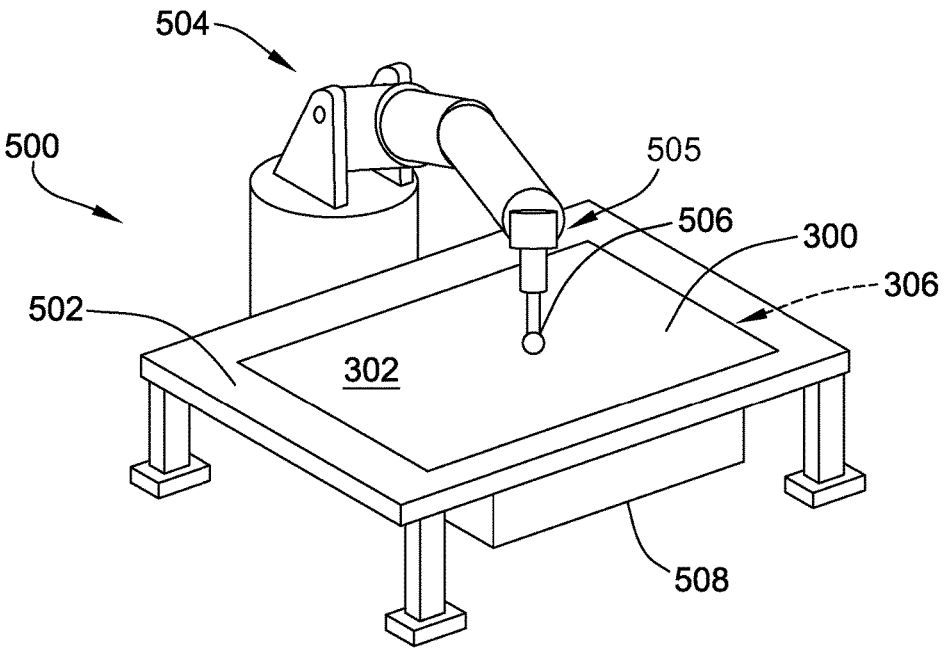
FIG. 4 is a schematic view of a first exemplary embodiment of an incremental sheet forming system that may be used to form the exemplary component shown in FIGS. 1 and 2 from the exemplary tailored blank shown in FIG. 3.

The relationship of each portion of tailored blank 300 to a corresponding portion of the finished component 200 formed from tailored blank 300 will be described herein in detail with reference to FIGS. 2 and 3. First, however, it is instructive to describe example, non-limiting embodiments of systems that may be used in an incremental sheet forming process. For example, tailored blank 300 may be formed into sheet metal component 200 using any suitable single point or two point incremental sheet forming system. FIG. 4 is a schematic view of a first exemplary embodiment of an incremental sheet forming system 500 that may be used to form sheet metal component 200 from tailored blank 300. System 500 includes a fixture 502 configured to clamp a perimeter 306 of tailored blank 300. While fixture 502 holds perimeter 306 of tailored blank 300 in a substantially fixed location, a manufacturing robot 504 applies a tool 506, such as but not limited to a stylus, to a series of predetermined locations on a first side 302 of blank 300. For example, tool 506 is coupled to an end effector 505 of manufacturing robot 504. For single point incremental forming, manufacturing robot 504 applies tool 506 at each predetermined location to produce, for example, a predetermined local displacement of, or a predetermined local force applied to, blank 300. In some embodiments, manufacturing robot 504 further applies tool 506 to at least some of the predetermined locations of blank 300 to locally conform blank 300 to a contoured surface (not shown) of a tool support 508 positioned on a second side 304 of tailored blank 300, opposite first side 302. Moreover, in certain embodiments, tool support 508 is movable relative to fixture 502 during the incremental sheet forming process.

The predetermined locations, predetermined displacements, predetermined forces, and/or contoured surface are selected in any suitable fashion to form tailored blank 300 into sheet metal component 200. For example, but not by way of limitation, manufacturing robot 504 applies tool 506 in a sequence that includes multiple applications to at least some of the predetermined locations of tailored blank 300. In some embodiments, manufacturing robot 504 is a computer numerically controlled (CNC) device that is suitably programmed to apply tool 506 to form tailored blank 300 into sheet metal component 200. In certain embodiments, tool 506 is a plurality of tools 506 that are associated with end effector 505 of manufacturing robot 504. For example, plurality of tools 506 includes styli having one of a point, a pad, a ball, an angled application surface, and another suitable shape that enables tool 506 to form sheet metal component 200 from tailored blank 300 as described herein. In some embodiments, system 500 is configured to enable one of plurality of tools 506 to be replaced by another of plurality of tools 506 during a programmed sheet forming sequence.

Moreover, in certain embodiments, tool support 508 is a CNC device that is suitably programmed for repositioning to cooperate with manufacturing robot 504. For example, tool support 508 is controllable by one of the CNC controller for manufacturing robot 504 and an independent CNC controller. It should be understood that, although system 500 is illustrated with fixture 502 configured to hold blank 300 in a horizontal position and manufacturing robot 504 configured to operate on an upper surface of blank 300, in alternative embodiments, fixture 502 has any suitable orientation, such as but not limited to a vertical orientation or an obliquely inclined orientation, and manufacturing robot 504 is configured to operate on any suitable surface of blank 300, that enables sheet metal component 200 to be formed from tailored blank 300 as described herein.

Figure 5:
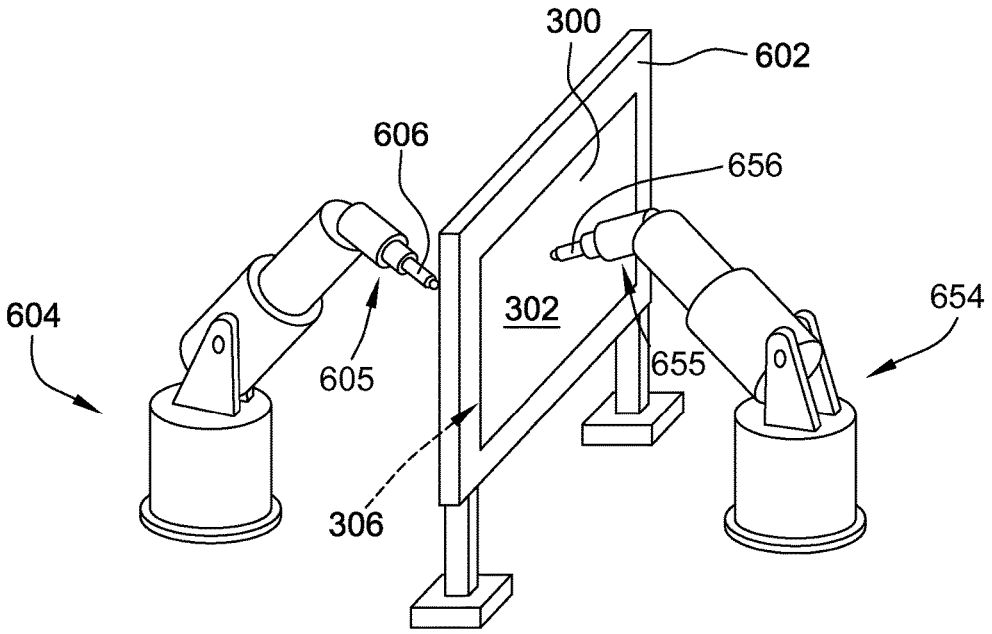
FIG. 5 is a schematic view of a second exemplary embodiment of an incremental sheet forming system that may be used to form the exemplary component shown in FIGS. 1 and 2 from the exemplary tailored blank shown in FIG. 3.

For another example, tailored blank 300 may be formed into sheet metal component 200 using any suitable double-sided incremental sheet forming system. FIG. 5 is a schematic view of a second exemplary embodiment of an incremental sheet forming system 600 that may be used to form sheet metal component 200 from tailored blank 300. System 600 includes a fixture 602 configured to clamp a perimeter 306 of tailored blank 300, and a pair of manufacturing robots 604 and 654 positioned on opposite sides of fixture 602. While fixture 602 holds perimeter 306 of tailored blank 300 in a substantially fixed location, manufacturing robots 604 and 654 each apply a respective tool 606 and 656, such as but not limited to a pair of styli, cooperatively or sequentially to a series of predetermined locations on opposite sides of tailored blank 300. For example, tool 606 is coupled to an end effector 605 of manufacturing robot 604, and tool 656 is coupled to an end effector 655 of manufacturing robot 654. Each manufacturing robot 604 and 654 applies the respective tool 606 and 656 at each respective predetermined location to produce, for example, a predetermined local displacement of, or a predetermined local force applied to, blank 300. In certain embodiments, the opposing manufacturing robots 604 and 654 operate such that at any given step in the incremental sheet forming process, either of the opposing tools 606 and 656 performs as a forming tool while the other of the opposing tools 606 and 656 performs as a tool support.

The predetermined locations, predetermined displacements, and/or predetermined forces are selected in any suitable fashion to form tailored blank 300 into sheet metal component 200. For example, but not by way of limitation, each manufacturing robot 604 and 654 applies the respective tool 606 and 656 in a sequence that includes multiple applications to at least some of the predetermined locations of tailored blank 300. In certain embodiments, each of the pair of manufacturing robots 604 and 654 are computer numerically controlled (CNC) devices that are suitably programmed to cooperate to apply each respective tool 606 and 656 to form tailored blank 300 into sheet metal component 200. For example, manufacturing robot 654 is controllable by one of a CNC controller for manufacturing robot 604 and an independent CNC controller. In certain embodiments, tool 606 is a plurality of tools 606 that are associated with end effector 605 of manufacturing robot 604, and tool 656 is a plurality of tools 656 that are associated with an end effector 655 of manufacturing robot 654. For example, each of plurality of tools 606 and 656 includes styli having one of a point, a pad, a ball, an angled application surface, a suitable tool support surface, or another suitable shape that enables tools 606 and 656 to form sheet metal component 200 from tailored blank 300 as described herein. In some embodiments, system 500 is configured to enable one of plurality of tools 606 and of 656 to be replaced by another of plurality of tools 606 and 656, respectively, during a programmed sheet forming sequence.

It should be understood that, although system 600 is illustrated with fixture 602 configured to hold blank 300 in a vertical position, in alternative embodiments, fixture 602 has any suitable orientation, such as but not limited to a horizontal orientation or an obliquely inclined orientation, and each manufacturing robot 604 and 654 is configured to operate on any suitable surface of blank 300, that enables sheet metal component 200 to be formed from tailored blank 300 as described herein.

In certain embodiments, at least one of end effectors 505, 605, and 655 is configured to apply thermal energy to a deformation zone on blank 300 proximate a tip of respective tools 506, 606, and 656. For example, at least one of end effectors 505, 605, and 655 is configured to apply thermal energy to a location on blank 300 ahead of the tip of respective tools 506, 606, and 656 for softening a material of blank 300 to facilitate deformation of blank 300. For another example, at least one of end effectors 505, 605, and 655 is configured to apply thermal energy to a location on blank 300 behind the tip of respective tools 506, 606, and 656 for annealing the material of blank 300 after a deformation. In certain embodiments, at least one of end effectors 505, 605, and 655 is configured to apply thermal energy to blank 300 using at least one of a resistive heating source, a hot gas source, a radiative heat source (such as, but not limited to, an infrared lamp), a continuous wave laser source, a pulsed laser source, an electrical current source, an ultrasonic generator, and another suitable source of thermal energy.

In some embodiments, systems 500 and 600 are configured to prevent deformation of the tailored blank 300 at at least one predetermined location 344 during the forming process. For example, blank 300 at each at least one predetermined location 344 includes a feature intended to be included on component 200, such as but not limited to at least one of a tag on one of surfaces 302 and 304 and an embedded device, and the feature could potentially be damaged by direct application of any of tools 506, 606, and 656. In certain embodiments, the CNC controllers associated with systems 500 and 600 are configured to prevent tools 506, 606, and 656 from directly contacting blank 300 at the at least one predetermined location 344 to facilitate inclusion of the undamaged feature on component 200.

It should be understood that the particular features of incremental sheet forming systems 500 and 600 described herein are for illustrative purposes, and are not intended to limit the embodiments described herein for forming a sheet metal component from a tailored blank. In alternative embodiments, any suitable incremental sheet forming system may be used that enables sheet metal component 200 to be formed from tailored blank 300 as described herein.

Returning to FIGS. 2 and 3, example embodiments of forming sheet metal component 200 from tailored blank 300 will be described with reference to example alterations to specified regions of tailored blank 300 (shown in FIG. 3), and a resulting characteristic of a corresponding region of sheet metal component 200 (shown in FIG. 2) as formed from tailored blank 300 by a suitable incremental sheet forming process. Generally, sheet metal component 200 defines a first surface 202 and an opposite second surface 204. Sheet metal component 200 has a thickness 206 defined between first surface 202 and second surface 204. In the exemplary embodiment, thickness 206 varies locally at different regions of sheet metal component 200, as a result of at least one of a configuration of tailored blank 300 and a deformation and stretching of the material of sheet metal component 200 caused by the incremental sheet forming process. Sheet metal component 200 also has a stiffness that varies locally at different regions of sheet metal component 200.

In certain embodiments, an initial blank is formed from a first material 308. In some embodiments, first material 308 is a uniform metal material, such as but not limited to one of titanium, steel, copper, and aluminum. It should be understood that first material 308 may include a coating on an outer surface thereof. For example, the initial blank may include at least one of a metallic coating, an oxidized compound formed from the first material, an anti-corrosive coating, a dielectric coating, a conductivity-enhancing coating, a friction optimization coating, a wear-reduction coating, a reflective coating, an anti-reflective coating, an absorptive coating, a reactive coating, a color coating, an aesthetic coating, and any other coating that facilitates an incremental sheet forming process and/or provides desired properties to any of first material 308, tailored blank 300, and sheet metal component 200.

The initial blank is then tailored, prior to and/or during the incremental sheet forming process, to form tailored blank 300 by at least one of (i) coupling additional material to a portion of first material 308, and (ii) removing first material 308 from a portion of the initial blank, to facilitate improved compliance of at least a portion of sheet metal component 200 with at least one of a specified thickness, a specified stiffness, and a specified geometry.

For example, in certain embodiments, sheet metal component 200 includes at least one first region 210 formed from a corresponding first region 310 of tailored blank 300. Each first region 310 of tailored blank 300 is characterized in that a portion of first material 308 used to initially form blank 300 is removed from blank 300 at each first region 310. For example, the portion of first material 308 within each first region 310 is at least one of machined, ground, cut (including, but not limited to, water-jet cutting), drilled, etched away, dissolved, and removed from first region 310 in any other suitable manner that enables first region 310 to function as described herein. As a result, each corresponding first region 210 of sheet metal component 200 has a resulting local thickness 206 that is decreased relative to a thickness that would result if first region 210 were formed from a similar blank with no removal of first material 308 from first region 310.

In certain embodiments, the resulting local thickness 206 of each corresponding first region 210, although decreased relative to a thickness that would result if first region 210 were formed from a similar blank with no removal of first material 308 from first region 310, remains sufficient to meet local stiffness and strength requirements for the at least one first region 210. As a result, removing the portion of first material 308 from each first region 310 enables sheet metal component 200 to have a decreased weight relative to a weight that would result if sheet metal component 200 were formed from a similar blank made with no removal of first material 308 from first region 310. In certain embodiments, such as those in which sheet metal component 200 is a component of aircraft 102, such a weight reduction represents a substantial performance benefit. Moreover, in certain embodiments, removal of the same amount of first material 308 from the at least one first region 210 after sheet metal component 200 is formed into a complex geometry would present substantially more technical difficulty, and thus a correspondingly greater time and expense, than removing the portion of first material 308 from first region 310 of the substantially flat tailored blank 300 prior to and/or during the incremental sheet forming process.

In certain embodiments, the at least one first region 210 of sheet metal component 200 is adjacent a portion of sheet metal component 200 that has a large or "steep" slope relative to plane 207. In the illustrated embodiment, for example, the at least one first region 210 includes a pair of first regions 210 that form a substantially flat cap surface of an inverted cup-like shape. A perimeter of each first region 210 is defined by a wall portion 212 of the inverted cup-like shape. Due to the relatively large slope of wall portions 212 relative to plane 207, thickness 206 of wall portions 212 is substantially thinned during the incremental sheet forming process. As a result, the thickness of first material 308 of tailored blank 300 is selected to be relatively large to ensure that thickness 206 of wall portions 212 remains sufficient to meet local stiffness and strength requirements. In contrast, thickness 206 of substantially flat first regions 210 is not thinned as much during the incremental sheet forming process, and the relatively large initial thickness of first material 308 is unnecessary to meet local stiffness and strength requirements for first regions 210. Moreover, as described above, removal of the same amount of first material 308 from first regions 210 after sheet metal component 200 is formed would present substantially more technical difficulty, and thus a correspondingly greater time and expense, than removing the portion of first material 308 from corresponding first regions 310 of tailored blank 300 prior to and/or during the incremental sheet forming process.

Additionally or alternatively, removing the portion of first material 308 from corresponding first regions 310 of tailored blank 300 prior to and/or during the incremental sheet forming process alters a deformation and flow behavior of first material 308 during the incremental forming process in a region adjacent to first region 310. In certain embodiments, the altered deformation and flow behavior of first material 308 during the incremental sheet forming process in the region adjacent to first region 310 enables at least one of (i) first region 210 of sheet metal component 200 to meet local stiffness and strength requirements, (ii) a region adjacent to first region 210 to meet local stiffness and strength requirements, (iii) a reduction in an energy required to form sheet metal component 200 from blank 300, and (iv) a simplification of a tool path, for example a tool path of tools 506 or 606 (shown in FIGS. 4 and 5), required to form sheet metal component 200 from blank 300.

It should be understood that in alternative embodiments, the at least one first region 210 of sheet metal component 200 is other than adjacent a portion of sheet metal component 200 that has a large slope. For example, the at least one first region 210 is not limited to a pair of inverted cup shaped regions as illustrated, but rather the at least one first region 210 includes any suitable number of first regions 210, and each first region 210 has any suitable shape, that enables sheet metal component 200 to function and to be formed from tailored blank 300 as described herein.

In certain embodiments, the removal of the portion of first material 308 from the at least one first region 310 is performed while tailored blank 300 is coupled to the same system that is used to perform the incremental sheet forming process. For example, with reference to FIGS. 4 and 5, the removal of the portion of first material 308 from the at least one first region 310 is performed while tailored blank 300 is coupled to fixture 502 of incremental sheet forming system 500 or fixture 602 of incremental sheet forming system 600. In some embodiments, tool 506 of incremental sheet forming system 500, and/or at least one tool 606 of incremental sheet forming system 600, is selectable between an incremental sheet forming tool, such as but not limited to a stylus, and a machining tool configured to remove the portion of first material 308 from the at least one first region 310, such as but not limited to a grinder. In alternative embodiments, each tool 506 and/or 606 is limited to an incremental sheet forming tool, and system 500 and/or system 600 includes an additional manufacturing robot (not shown) that includes a machine grinding tool. Removal of the portion of first material 308 from the at least one first region 310 while tailored blank 300 is coupled to fixture 502 or 602 facilitates shaping and placement of the at least one first region 210 within very tight tolerances, because the machining process and the incremental sheet forming process are both performed without a need to re-position tailored blank 300 with respect to each tool. Moreover, because tailored blank 300 remains fixed in fixture 502 or 602, the shaping and placement of the at least one first region 210 within very tight tolerances is maintainable throughout multiple iterative sequences of machining and incremental sheet forming. In alternative embodiments, removal of the portion of first material 308 from the at least one first region 310 is at least partially performed other than while tailored blank 300 is coupled to the same system that is used to perform the incremental sheet forming process.

Returning again to FIGS. 2 and 3, for another example, in certain embodiments, sheet metal component 200 includes at least one second region 220 formed from a corresponding second region 320 of tailored blank 300. Each second region 320 of tailored blank 300 is characterized in that a cladding material 322 is coupled to first material 308 used to initially form blank 300. For example, cladding material 322 is coupled to first material 308 within each second region 320 by at least one of welding, brazing, plating, adhesive, fasteners (such as, for example, at least one of rivets, screws, and bolts), clamping, and addition to second region 320 in any other suitable manner that enables second region 320 to function as described herein. As an additional example, in certain embodiments, at least one of end effectors 505, 605, and 655 (shown in FIGS. 5 and 6) is configured to couple cladding material 322 to tailored blank 300 before or during the incremental sheet forming process performed using system 500 or 600, respectively. As a result of coupling cladding material 322 to tailored blank 300, each corresponding second region 220 of sheet metal component 200 has a resulting local thickness 206 that is increased relative to a thickness that would result if second region 220 were formed from a similar blank made without cladding material 322.

In certain embodiments, cladding material 322 is applied circumferentially around dome-shaped feature 203 (best viewed in FIG. 1) of component 200. In other embodiments, cladding material 322 is applied only on one or more sections 201 of component 200. Moreover, in some embodiments, cladding material 322 does not extend across a width of a radial section 201, but rather is applied to a second region 320 of blank 300 that has any suitable shape and size. More generally, it should be understood that, although sheet metal component 200 and tailored blank 300 each are illustrated as having a specific shape for purposes of description, each of sheet metal component 200 and tailored blank 300 may have any suitable shape, and cladding material 322 may be applied to any suitable portion of tailored blank 300, such that sheet metal component 200 can be formed from tailored blank 300 according the embodiments described herein.

In certain embodiments, the resulting local thickness 206 of each corresponding second region 220 enables the at least one second region 220 to meet local stiffness and strength requirements for the at least one second region 220, without increasing thickness 206 for other portions of sheet metal component 200. As a result, coupling cladding material 322 to first material 308 in second regions 320 of tailored blank 300 enables sheet metal component 200 to have a decreased weight relative to a weight that would result if sheet metal component 200 were formed from a blank made of uniformly thicker first material 308. In certain embodiments, such as those in which sheet metal component 200 is a component of aircraft 102, such a weight reduction represents a substantial performance benefit. Moreover, in certain embodiments, such as where at least one second region 220 presents a curved contour, coupling cladding material 322 to first material 308 in the at least one second region 220 after sheet metal component 200 is formed would present substantially more technical difficulty, and thus a correspondingly greater time and expense, than coupling cladding material 322 to first material 308 in second region 320 of the substantially flat tailored blank 300 prior to and/or during the incremental sheet forming process.

In the illustrated embodiment, for example, the at least one second region 220 is a single sloped region that extends across sheet metal component 200. Due to the slope, thickness 206 in second region 220 is subjected to substantial thinning during the incremental sheet forming process. A thickness of cladding material 322 of tailored blank 300 is selected to ensure that the resulting thickness 206 of second region 220 is sufficient to meet local stiffness and strength requirements.

Additionally or alternatively, cladding material 322 added to second region 320 prior to and/or during the incremental sheet forming process alters a deformation and flow behavior of first material 308 during the incremental forming process in at least one of second region 320 and a region adjacent to second region 320. In certain embodiments, the altered deformation and flow behavior of first material 308 during the incremental sheet forming process in the at least one of second region 320 and the region adjacent to second region 320 enables (i) second region 220 of sheet metal component 200 to meet local stiffness and strength requirements, (ii) a region adjacent to second region 220 to meet local stiffness and strength requirements, (iii) a reduction in an energy required to form sheet metal component 200 from blank 300, and (iv) a simplification of a tool path, for example a tool path of tools 506 or 606 (shown in FIGS. 4 and 5), required to form sheet metal component 200 from blank 300. Moreover, in some embodiments, the altered deformation and flow behavior of first material 308 during the incremental sheet forming process in the at least one of second region 320 and the region adjacent to second region 320 enables such benefits even if all or part of cladding material 322 is subsequently removed from sheet metal component 200. In some such embodiments, after at least a portion of the incremental sheet forming process is completed, at least a portion of cladding material 322 is uncoupled from second region 220 and is not included in the finished sheet metal component 200. For example, at least a portion of cladding material 322 is at least one of unfastened, unclamped, machined, ground, cut, etched away, dissolved and removed in any other suitable manner that enables second region 220 to function as described herein. In certain embodiments, removal of cladding material 322 is performed while tailored blank 300 is coupled to the same system that is used to perform the incremental sheet forming process, as described above with respect to formation of first regions 310. In alternative embodiments, removal of at least a portion of cladding material 322 is performed while tailored blank 300 is other than coupled to the same system that is used to perform the incremental sheet forming process. Alternatively, substantially all of cladding material 322 remains coupled to the finished sheet metal component 200.

It should be understood that in alternative embodiments, the at least one second region 220 is not limited to a single sloped region as illustrated, but rather the at least one second region 220 includes any suitable number of second regions 220, and each second region 220 has any suitable shape, that enables sheet metal component 200 to function and to be formed from tailored blank 300 as described herein.

In certain embodiments, cladding material 322 is formed from a material that is substantially identical to first material 308 used to initially form tailored blank 300. In alternative embodiments, cladding material 322 is formed from a material that is other than substantially identical to first material 308.

For another example, in certain embodiments, sheet metal component 200 includes at least one third region 230 formed from a corresponding third region 330 of tailored blank 300. Each third region 330 of tailored blank 300 is characterized in that at least one stiffening member 332 is coupled to first material 308 used to initially form blank 300. For example, the at least one stiffening member 332 is coupled to first material 308 within each third region 330 by at least one of welding, brazing, plating, adhesive, fasteners, and addition to third region 330 in any other suitable manner that enables third region 330 to function as described herein. In certain embodiments, each at least one stiffening member 332 is coupled to one of first surface 302 and second surface 304 of blank 300. In alternative embodiments, at least one stiffening member 332 is coupled within a groove or notch (not shown) formed in first material 308, such that the stiffening member 332 is at least partially recessed below one of first surface 302 and second surface 304. As a result of coupling the at least one stiffening member 332 to tailored blank 300, each corresponding third region 230 of sheet metal component 200 has a resulting local stiffness that is increased relative to a stiffness that would result if third region 230 were formed from a similar blank made without stiffening member 332.

In certain embodiments, the resulting local stiffness of each corresponding third region 230 enables the at least one third region 230 to meet local stiffness requirements for the at least one third region 230, without increasing thickness 206 for other portions of sheet metal component 200. For example, but not by way of limitation, the at least one stiffening member 332 inhibits a tendency of sheet metal component 200 to exhibit a "springback" characteristic in the at least one third region 230, that is, a tendency of a contour of the at least one third region 230 to curl or snap out of compliance with its designed or intended shape. As a result, coupling the at least one stiffening member 332 to first material 308 in third regions 330 of tailored blank 300 enables sheet metal component 200 to have a decreased weight relative to a weight that would result if sheet metal component 200 were formed from a blank made of uniformly thicker first material 308 in third regions 330. In certain embodiments, such as those in which sheet metal component 200 is a component of aircraft 102, such a weight reduction represents a substantial performance benefit. Moreover, in certain embodiments, such as where at least one third region 230 presents a curved contour, coupling the at least one stiffening member 332 to first material 308 in the at least one third region 230 after sheet metal component 200 is formed would present substantially more technical difficulty, and thus a correspondingly greater time and expense, than coupling the at least one stiffening member 332 to first material 308 in third region 330 of the substantially flat tailored blank 300 prior to and/or during the incremental sheet forming process.

In the illustrated embodiment, for example, the at least one third region 230 is a single region that extends across sheet metal component 200 in which sheet metal component 200 transitions from a relatively flat portion to a sloped portion. Due to the transition, the incremental sheet forming process causes thickness 206 in third region 230 to vary substantially, which tends to increase a susceptibility of third region 230 to springback. The at least one stiffening member 332 increases a bending and torsional stiffness of third region 230 about an axis 334 transverse to the direction of elongation. At least one of a number, an orientation, a cross-sectional shape, and a thickness of the at least one stiffening member 332 of tailored blank 300 is selected to inhibit springback of sheet metal component 200 about axis 334 and, additionally or alternatively, to ensure that the resulting stiffness of third region 230 is otherwise sufficient to meet local stiffness requirements. For example, the at least one stiffening member 332 in the example illustrated in FIGS. 2 and 3 includes three evenly spaced elongated stiffening members 332, and each stiffening member 332 is one of a wire segment and a hat stiffener. It should be understood that in alternative embodiments, at least one stiffening member 332 is not limited to three evenly spaced, parallel elongated members, but rather the at least one stiffening member 332 has any suitable number, configuration, and spacing that enables sheet metal component 200 to function and to be formed from tailored blank 300 as described herein. For example, in some embodiments, the at least one stiffening member 332 includes a plurality of stiffening members 332 in which some are oriented perpendicular or obliquely with respect to others. In some such embodiments, the plurality of stiffening members 332 is oriented in a grid configuration that adds stiffness in multiple directions to third region 230. For another example, in certain embodiments, the at least one stiffening member 332 includes at least one curved stiffening member 332.

Additionally or alternatively, the at least one stiffening member 332 added to third region 330 prior to and/or during the incremental sheet forming process alters a deformation and flow behavior of first material 308 during the incremental forming process in at least one of third region 330 and a region adjacent to third region 330. In certain embodiments, the altered deformation and flow behavior of first material 308 during the incremental sheet forming process in the at least one of third region 330 and the region adjacent to third region 330 enables (i) third region 230 of sheet metal component 200 to meet local stiffness and strength requirements, (ii) a region adjacent to third region 230 to meet local stiffness and strength requirements, (iii) a reduction in an energy required to form sheet metal component 200 from blank 300, and (iv) a simplification of a tool path, for example a tool path of tools 506 or 606 (shown in FIGS. 4 and 5), required to form sheet metal component 200 from blank 300. Moreover, in some embodiments, the altered deformation and flow behavior of first material 308 during the incremental sheet forming process in the at least one of third region 330 and the region adjacent to third region 330 enables such benefits even if all or part of the at least one stiffening member 332 is subsequently removed from sheet metal component 200. In some such embodiments, after at least a portion of the incremental sheet forming process is completed, at least a portion of the at least one stiffening member 332 is uncoupled from third region 230 and is not included in the finished sheet metal component 200. For example, at least a portion of the at least one stiffening member 332 is at least one of unfastened, unclamped, machined, ground, cut, etched away, dissolved, and removed in any other suitable manner that enables third region 230 to function as described herein. In certain embodiments, removal of the at least one stiffening member 332 is performed while tailored blank 300 is coupled to the same system that is used to perform the incremental sheet forming process, as described above with respect to formation of first regions 310. In alternative embodiments, removal of at least a portion of the at least one stiffening member 332 is performed while tailored blank 300 is other than coupled to the same system that is used to perform the incremental sheet forming process. Alternatively, substantially all of the at least one stiffening member 332 remains coupled to the finished sheet metal component 200.

It should be understood that in alternative embodiments, the at least one third region 230 is not limited to a single region in which sheet metal component 200 transitions from a relatively flat portion to a sloped portion as illustrated, but rather the at least one third region 230 includes any suitable number of third regions 230, and each third region 230 has any suitable shape, that enables sheet metal component 200 to function and to be formed from tailored blank 300 as described herein.

In certain embodiments, the at least one stiffening member 332 is formed from a material that is substantially identical to first material 308 used to initially form tailored blank 300. In alternative embodiments, the at least one stiffening member 332 is formed from a material that is other than substantially identical to first material 308. For example, but not by way of limitation, the at least one stiffening member 332 is formed from a material that has an increased stiffness relative to first material 308.

For another example, in certain embodiments, sheet metal component 200 includes at least one fourth region 240 formed from a corresponding fourth region 340 of tailored blank 300. Each fourth region 340 of tailored blank 300 is characterized in that first material 308 used to initially form blank 300 is completely removed from fourth region 340, and a fourth material 342 is coupled to at least a portion of first material 308 abutting fourth region 340. For example, fourth material 342 is coupled edge-to-edge to at least a portion of first material 308 abutting each fourth region 340, such as by butt-welding or another suitable butt-joining process. Alternatively, fourth material 342 is coupled to at least a portion of first material 308 abutting each fourth region 340 in any other suitable manner that enables fourth region 340 to function as described herein. As a result of coupling fourth material 342 to tailored blank 300, each corresponding fourth region 240 of sheet metal component 200 has at least one material property, such as a weight and/or a local stiffness, that is altered from the material property that would result if fourth region 240 were formed from a similar blank made without replacing first material 308 with fourth material 342.

In certain embodiments, the initial blank formed from first material 308 has a substantially uniform thickness. Moreover, in certain embodiments, fourth material 342 is selected to have an initial thickness prior to the incremental sheet forming process that is substantially identical to the initial thickness of the initial blank. Alternatively, the initial blank formed from first material 308 has other than a substantially uniform thickness, and/or fourth material 342 is selected to have an initial thickness prior to the incremental sheet forming process that is other than substantially identical to the initial thickness of first material 308 of blank 300 prior to the incremental sheet forming process.

In certain embodiments, the initial thickness of the at least one fourth region 340 being substantially equal to the initial thickness of other portions of perimeter 306 of tailored blank 300 facilitates fixing tailored blank 300 in a fixture of a standard incremental sheet forming system, such as fixture 502 of system 500 (shown in FIG. 4) or fixture 602 of system 600 (shown in FIG. 5), while producing a different material property within at least one fourth region 240 that lies on a perimeter of sheet metal component 200. For example, fourth material 342 enables the at least one fourth region 240 to meet local stiffness and strength requirements without requiring modifications to fixture 502 or fixture 602 to accommodate a variation in thickness along perimeter 306 that would result from a use of cladding material 322 or stiffening member 332 along perimeter 306. Moreover, in certain embodiments, such as where at least one fourth region 240 presents a curved contour, coupling cladding material 322 or stiffening member 332 to sheet metal component 200 after sheet metal component 200 is formed would present substantially more technical difficulty, and thus a correspondingly greater time and expense, than replacing first material 308 with fourth material 342 in the at least one fourth region 340 of the substantially flat tailored blank 300 prior to and/or during the incremental sheet forming process.

In the illustrated embodiment, for example, the at least one fourth region 240 is a peripheral region of sheet metal component 200 that is designed to serve as an attachment point or reference locating point for another component (not shown). Thus, a blank formed entirely of first material 308 would require an enhanced thickness to enable sheet metal component 200 to comply with the local strength requirements for fourth region 340. Fourth material 342 is selected to have increased strength properties relative to first material 308, such that a lesser thickness 206 of fourth material 342 in fourth region 240 is sufficient to meet the local strength requirements. The replacement of first material 308 with fourth material 342 in fourth region 340 of tailored blank 300 enables the local strength requirements for fourth region 240 of sheet metal component 200 to be met without increasing an overall thickness of the other portions of blank 300, and thus without increasing thickness 206 of other regions of sheet metal component 200. As a result, coupling fourth material 342 to at least a portion of first material 308 adjacent fourth region 340 of tailored blank 300 enables sheet metal component 200 to have a decreased weight relative to a weight that would result if sheet metal component 200 were formed from a blank made of uniformly thicker first material 308.

Additionally or alternatively, fourth material 342 added to fourth region 340 prior to the incremental sheet forming process alters a deformation and flow behavior of first material 308 during the incremental forming process in a region adjacent to fourth region 340. In certain embodiments, the altered deformation and flow behavior of first material 308 during the incremental sheet forming process in fourth region 340 enables (i) fourth region 240 of sheet metal component 200 to meet local stiffness and strength requirements, (ii) a region adjacent to fourth region 240 to meet local stiffness and strength requirements, (iii) a reduction in an energy required to form sheet metal component 200 from blank 300, and (iv) a simplification of a tool path, for example a tool path of tools 506 or 606 (shown in FIGS. 4 and 5), required to form sheet metal component 200 from blank 300. Moreover, in some embodiments, the altered deformation and flow behavior of first material 308 during the incremental sheet forming process in the at least one of fourth region 340 and the region adjacent to fourth region 340 enables such benefits even if all or part of fourth material 342 is subsequently removed from sheet metal component 200. In some such embodiments, after at least a portion of the incremental sheet forming process is completed, at least a portion of fourth material 342 is uncoupled from fourth region 240 and is not included in the finished sheet metal component 200. For example, at least a portion of fourth material 342 is at least one of unfastened, unclamped, machined, ground, cut, etched away, dissolved, and removed in any other suitable manner that enables sheet metal component 200 to function as described herein. In certain embodiments, removal of fourth material 342 is performed while tailored blank 300 is coupled to the same system that is used to perform the incremental sheet forming process, as described above with respect to formation of first regions 310. In alternative embodiments, removal of at least a portion of fourth material 342 is performed while tailored blank 300 is other than coupled to the same system that is used to perform the incremental sheet forming process. Alternatively, substantially all of fourth material 342 remains coupled to the finished sheet metal component 200.

It should be understood that in alternative embodiments, the at least one fourth region 240 is not limited to a peripheral region and/or to use as an attachment point for another component as illustrated, but rather the at least one fourth region 240 includes any suitable number of fourth regions 240, and each fourth region 240 has any suitable shape and position on tailored blank 300, that enables sheet metal component 200 to function and to be formed from tailored blank 300 as described herein.

Figure 6:
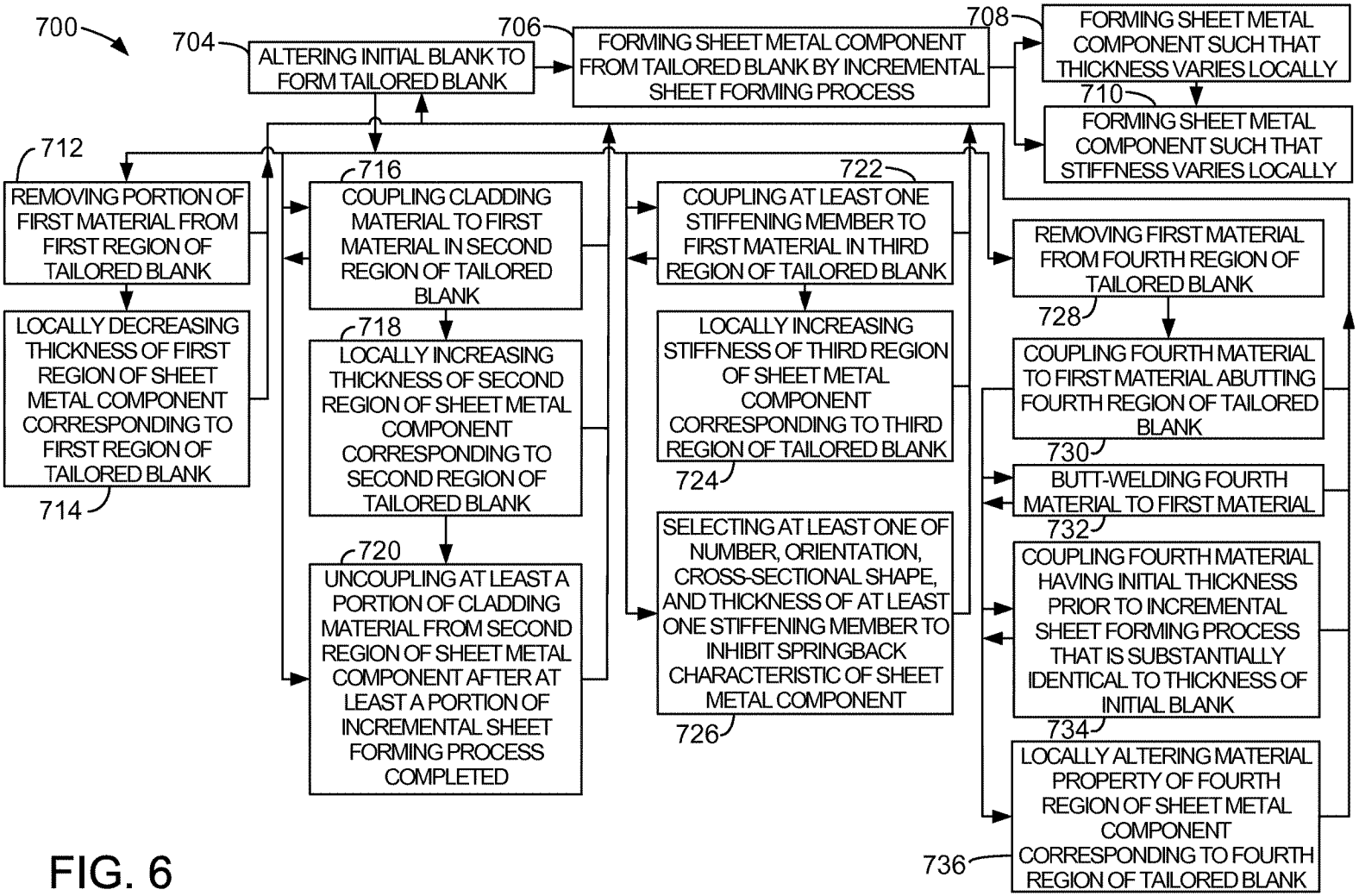
FIG. 6 is a flow diagram of an exemplary method of making a sheet metal component, such as the exemplary sheet metal component shown in FIGS. 1 and 2, from a tailored blank, such as the exemplary tailored blank shown in FIG. 3.

FIG. 6 is a flow diagram of an exemplary embodiment of a method 700 of making a sheet metal component, such as sheet metal component 200, from a tailored blank, such as tailored blank 300. With reference to FIGS. 1-6, in the exemplary embodiment, method 700 includes altering 704 an initial blank formed from a first material, such as first material 308, to form the tailored blank by at least one of (i) coupling additional material, such as at least one of cladding material 322, stiffening member 332, and fourth material 342, to a portion of the first material, and (ii) removing the first material from a portion of the initial blank. Method 700 further includes forming 706 the sheet metal component from the tailored blank by an incremental sheet forming process, such as but not limited to a single point incremental sheet forming process or a two point incremental sheet forming process, as performed by a system such as system 500, or a double-sided incremental sheet forming process, as performed by a system such as system 600.

In certain embodiments, the sheet metal component has a thickness defined between a first surface and a second surface of the sheet metal component, such as thickness 206 defined between first surface 202 and second surface 204 of sheet metal component 200, and forming 706 the sheet metal component includes forming 708 the sheet metal component such that the thickness varies locally at different regions of the sheet metal component. Additionally or alternatively, the sheet metal component has a stiffness, and forming 706 the sheet metal component includes forming 710 the sheet metal component such that the stiffness varies locally at different regions of the sheet metal component.

In some embodiments, altering 704 the initial blank includes removing 712 a portion of the first material from at least one first region, such as first region 310, of the tailored blank. Moreover, in certain such embodiments, the sheet metal component has a thickness defined between a first surface and a second surface of the sheet metal component, such as thickness 206 defined between first surface 202 and second surface 204 of sheet metal component 200, and removing 712 the portion of the first material from the at least one first region of the tailored blank includes locally decreasing 714 the thickness of at least one first region of the sheet metal component, such as the at least one first region 210, corresponding to the at least one first region of the tailored blank. Further, in some such embodiments, the at least one first region of the sheet metal component is adjacent a portion of the sheet metal component that has a large slope, such as but not limited to wall portion 212.

In some embodiments, removing 712 the portion of the first material from the at least one first region of the tailored blank is performed while the tailored blank is coupled to a system, such as system 500 or system 600, that is used to perform the incremental sheet forming process.

In certain embodiments, altering 704 the initial blank comprises coupling 716 a cladding material, such as cladding material 322, to the first material in at least one second region, such as second region 320, of the tailored blank. In some such embodiments, the sheet metal component has a thickness defined between a first surface and a second surface of the sheet metal component, such as thickness 206 defined between first surface 202 and second surface 204 of sheet metal component 200, and coupling 716 the cladding material to the first material in the at least one second region of the tailored blank comprises locally increasing 718 the thickness of at least one second region of the sheet metal component, such as the at least one second region 220, corresponding to the at least one second region of the tailored blank.

In certain embodiments, method 700 further includes uncoupling 720 at least a portion of the cladding material from the second region of the sheet metal component after at least a portion of the incremental sheet forming process is completed. In some such embodiments, uncoupling 720 at least a portion of the cladding material from the second region of the sheet metal component is performed while the tailored blank is coupled to a system, such as system 500 or system 600, that is used to perform the incremental sheet forming process.

In some embodiments, the cladding material is formed from a material that is other than substantially identical to first material.

In certain embodiments, altering 704 the initial blank comprises coupling 722 at least one stiffening member, such as the at least one stiffening member 332, to the first material in at least one third region, such as the at least one third region 330 of the tailored blank. In some such embodiments, coupling 722 the at least one stiffening member to the first material in the at least one third region of the tailored blank includes locally increasing a stiffness of at least one third region of the sheet metal component, such as the at least one third region 230, corresponding to the at least one third region of the tailored blank. Moreover, in some such embodiments, method 700 further includes selecting 726 at least one of a number, an orientation, a cross-sectional shape, and a thickness of the at least one stiffening member to inhibit a springback characteristic of the sheet metal component.

In some embodiments, the at least one stiffening member is formed from a material that is other than substantially identical to first material.

In certain embodiments, altering 704 the initial blank includes removing 728 the first material from at least one fourth region of the tailored blank, such as the at least one fourth region 340, and coupling 730 a fourth material, such as fourth material 342, to at least a portion of the first material abutting the at least one fourth region of the tailored blank. In some embodiments, coupling 730 the fourth material to at least a portion of the first material abutting the at least one fourth region of the tailored blank includes butt-welding 732 the fourth material to the at least a portion of the first material. In certain embodiments, the initial blank formed from the first material has a thickness, and coupling 730 the fourth material to at least a portion of the first material abutting the at least one fourth region of the tailored blank includes coupling 734 the fourth material having an initial thickness prior to the incremental sheet forming process that is substantially identical to the thickness of the initial blank. In some embodiments, coupling 730 the fourth material to at least a portion of the first material abutting the at least one fourth region of the tailored blank comprises locally altering 736 at least one material property of at least one fourth region of the sheet metal component, such as the at least one fourth region 240, corresponding to the at least one fourth region of the tailored blank.

Referring again to the exemplary aircraft manufacturing and service method 100 as shown in FIG. 7 and the exemplary aircraft 102 as shown in FIG. 8, during pre-production, exemplary method 100 may include specification and design 104 of the aircraft 102 and material procurement 106. During production, component and subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 8, the aircraft 102 produced by exemplary method 100 may include an airframe 118 with a plurality of systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the invention may be applied to other industries, such as the automotive industry.

Apparatus and methods embodied herein may be employed during any one or more of the stages of the production and service method 100, and particularly during at least one of component and subassembly manufacturing 108, system integration 110, and routine maintenance and service 116 for airframe 118, for example. For example, components or subassemblies corresponding to production process 108 may be fabricated or manufactured in a manner similar to components or subassemblies produced while the aircraft 102 is in service. Also, one or more apparatus embodiments, method embodiments, or a combination thereof may be utilized during the production stages 108 and 110, for example, by substantially expediting assembly of or reducing the cost of an aircraft 102. Similarly, one or more of apparatus embodiments, method embodiments, or a combination thereof may be utilized while the aircraft 102 is in service, for example and without limitation, to maintenance and service 116. For example, but not by way of limitation, the apparatus and methods provide for rapid, low-cost manufacture of a component singly or in small lots, which facilitates concept evaluation at a design stage as well as on-demand spare parts manufacture with reduced need for inventory/storage, in addition to the above-referenced prototyping, production, service, maintenance, overhaul, and repair stages.

The embodiments described herein provide improvements over at least some known methods for forming sheet metal components. As compared to at least some known methods for forming sheet metal components, the embodiments described herein provide for using a tailored blank in an incremental sheet forming process to enable improved compliance with at least one of a specified thickness, a specified stiffness, and a specified geometry for at least a portion of a sheet metal component formed from the blank. As compared to at least some known methods for forming sheet metal components, the embodiments described herein provide for changing the thickness and/or stiffness of the sheet metal component locally, which in some embodiments results in at least one of a reduction of a weight the sheet metal component and an increase in a speed of forming the sheet metal component. In addition, the embodiments described herein provide for removal of a portion of material of the tailored blank while the tailored blank is coupled to the fixture used for the incremental sheet forming process, which facilitates shaping and placement of the alterations of the tailored blank within very tight tolerances.

This written description uses examples to disclose various implementations, which include the best mode, to enable any person skilled in the art to practice those implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of making a sheet metal component from a tailored blank, said method comprising:

providing an initial blank formed from a first material and having an initial thickness;

completely separating less than the initial thickness of the first material from a region of the initial blank to form a tailored blank, wherein the complete separation of the first material results in a thinned interior portion of the tailored blank, the thinned interior portion of the tailored blank having a nonzero local thickness that is less than the initial thickness, and wherein the thinned interior portion of the tailored blank is enclosed by portions of the tailored blank that retain the initial thickness; and forming the sheet metal component from the tailored blank by an incremental sheet forming process.

2. The method of claim 1, wherein the sheet metal component has a thickness defined between a first surface and a second surface of the sheet metal component, said forming the sheet metal component comprises forming the sheet metal component such that the thickness varies locally at different regions of the sheet metal component.

3. The method of claim 1, wherein the sheet metal component has a stiffness, said forming the sheet metal component comprises forming the sheet metal component such that the stiffness varies locally at different regions of the sheet metal component.

4. The method of claim 1, wherein the sheet metal component has a thickness defined between a first surface and a second surface of the sheet metal component, said forming the sheet metal component from the tailored blank comprises forming the sheet metal component having a locally decreased thickness in a region of the sheet metal component corresponding to the thinned interior portion of the tailored blank.

5. The method of claim 4, wherein the region of the sheet metal component is adjacent a portion of the sheet metal component that has a large slope.

6. The method of claim 1, wherein said forming the sheet metal component from the tailored blank by the incremental sheet forming process further comprises preventing deformation of the tailored blank at at least one predetermined location.

7. The method of claim 1, wherein said forming the sheet metal component from the tailored blank by the incremental sheet forming process further comprises applying thermal energy to a deformation zone on the tailored blank.

8. The method of claim 1, wherein the first material comprises a coating on an outer surface thereof.

9. The method of claim 8, wherein the coating comprises at least one of a metallic coating, an oxidized compound formed from the first material, an anti-corrosive coating, a dielectric coating, a conductivity-enhancing coating, a friction optimization coating, a wear-reduction coating, a reflective coating, an anti-reflective coating, an absorptive coating, a reactive coating, a color coating, and an aesthetic coating.

10. A method of making a sheet metal component from a tailored blank, said method comprising:

altering an initial blank formed from a first material to form the tailored blank by removing a portion of the first material from at least one first region of the tailored blank; and forming the sheet metal component from the tailored blank by an incremental sheet forming process, wherein said removing the portion of the first material from the at least one first region of the tailored blank is performed while the tailored blank is coupled to a system that is used to perform the incremental sheet forming process.

11. A method of making a sheet metal component from a tailored blank, said method comprising:

altering an initial blank formed from a first material to form the tailored blank by coupling a cladding material to the first material to form a cladded portion of the tailored blank;

forming the sheet metal component from the tailored blank by an incremental sheet forming process; and uncoupling at least a portion of the cladding material from the sheet metal component after at least a portion of the incremental sheet forming process is completed.

12. The method of claim 11, wherein the sheet metal component has a thickness defined between a first surface and a second surface of the sheet metal component, said coupling the cladding material to the first material to form the cladded portion of the tailored blank comprises locally increasing the thickness of a region of the sheet metal component corresponding to the cladded portion of the tailored blank.

13. The method of claim 11, wherein said uncoupling at least a portion of the cladding material from the sheet metal component is performed while the tailored blank is coupled to the system that is used to perform the incremental sheet forming process.

14. The method of claim 11, wherein the cladding material is formed from a material that is other than substantially identical to first material.

15. The method of claim 11, wherein said forming the sheet metal component from the tailored blank by the incremental sheet forming process further comprises applying thermal energy to a deformation zone on the tailored blank.

16. The method of claim 11, wherein the first material comprises a coating on an outer surface thereof.

17. A method of making a sheet metal component from a tailored blank, said method comprising:

providing an initial blank formed from a first material and having opposing surfaces separated by a thickness of the initial blank;

coupling a plurality of elongated stiffening members to one of the opposing surfaces of the initial blank to form a tailored blank, wherein the plurality of elongated stiffening members are spaced apart and arranged parallel to each other such that an axis of elongation of each of the elongated stiffening members transversely crosses an axis of the tailored blank, and wherein each of the elongated stiffening members is a wire segment; and forming the sheet metal component from the tailored blank by an incremental sheet forming process, wherein the incremental sheet forming process includes bending the tailored blank about the axis.

18. The method of claim 17, wherein said coupling the plurality of elongated stiffening members to form the tailored blank comprises locally increasing a stiffness of the sheet metal component about the axis of the tailored blank.

19. The method of claim 17, further comprising selecting at least one of a number, an orientation, a cross-sectional shape, and a thickness of the plurality of elongated stiffening members to inhibit a springback characteristic of the sheet metal component.

20. The method of claim 17, wherein the plurality of elongated stiffening members is formed from a material that is other than substantially identical to first material.

21. The method of claim 17, wherein said forming the sheet metal component from the tailored blank by the incremental sheet forming process further comprises applying thermal energy to a deformation zone on the tailored blank.

22. The method of claim 17, wherein the first material comprises a coating on an outer surface thereof.

23. A method of making a sheet metal component from a tailored blank, said method comprising:

providing an initial blank formed from a first material and having opposing surfaces separated by a thickness of the initial blank;

coupling a plurality of elongated stiffening members to one of the opposing surfaces of the initial blank to form a tailored blank, wherein the plurality of elongated stiffening members are spaced apart and arranged complementary to each other such that an axis of elongation of each of the elongated stiffening members transversely crosses an axis of the tailored blank, and wherein each of the elongated stiffening members has a constant cross section; and forming the sheet metal component from the tailored blank by an incremental sheet forming process, wherein the incremental sheet forming process includes bending the tailored blank about the axis.

* * * * *